US007806789B2

(12) United States Patent
Sledge

(10) Patent No.: US 7,806,789 B2
(45) Date of Patent: Oct. 5, 2010

(54) SPORTS RACKET

(76) Inventor: John L Sledge, 100 Park Ave., Suite 316, Calumet City, IL (US) 60409

( * ) Notice: Subject to any disclaimer, the term of this patent is extended or adjusted under 35 U.S.C. 154(b) by 545 days.

(21) Appl. No.: 11/799,812

(22) Filed: May 3, 2007

(65) Prior Publication Data

US 2008/0274842 A1 Nov. 6, 2008

(51) Int. Cl.
*A63B 49/02* (2006.01)

(52) U.S. Cl. ..... 473/524; 473/537; 473/543

(58) Field of Classification Search ..... 473/524, 473/535, 536, 537, 540, 543
See application file for complete search history.

(56) References Cited

U.S. PATENT DOCUMENTS

| | | | | | |
|---|---|---|---|---|---|
| 4,346,891 | A | * | 8/1982 | Epstein | 473/537 |
| 4,512,575 | A | * | 4/1985 | Tzeng | 473/537 |
| 4,662,634 | A | * | 5/1987 | Winkler | 473/537 |
| 4,732,384 | A | * | 3/1988 | Seymour | 473/537 |
| 4,834,383 | A | * | 5/1989 | Woehrle et al. | 473/539 |
| 5,080,361 | A | * | 1/1992 | Blanc et al. | 473/537 |
| 5,110,125 | A | * | 5/1992 | Blanc | 473/535 |
| 5,306,005 | A | * | 4/1994 | Lacoste et al. | 473/537 |
| 5,310,179 | A | * | 5/1994 | Takatsuka | 473/537 |
| 5,810,683 | A | * | 9/1998 | Davis | 473/546 |
| 5,823,899 | A | * | 10/1998 | Goodge | 473/540 |
| 5,913,740 | A | * | 6/1999 | Miklos | 473/537 |
| 2008/0274842 | A1 | * | 11/2008 | Sledge | 473/524 |

FOREIGN PATENT DOCUMENTS

| | | | | |
|---|---|---|---|---|
| DE | 3325098 | A1 | * | 1/1985 |
| DE | 3426798 | A1 | * | 1/1986 |
| GB | 2237513 | A | * | 5/1991 |
| JP | 08168540 | A | * | 7/1996 |
| JP | 2000189544 | A | * | 7/2000 |
| JP | 2003093548 | A | * | 4/2003 |
| JP | 2007130406 | A | * | 5/2007 |
| WO | WO 8910774 | A1 | * | 11/1989 |

* cited by examiner

*Primary Examiner*—Raleigh W. Chiu
(74) *Attorney, Agent, or Firm*—Oliff & Berridge, PLC; William P. Berridge; Andrew B. Whitehead

(57) ABSTRACT

A sports racket is provided with a uniform elongated string bed, uniform main strings and cross strings segments, a uniform elongated sweet spot, a uniform head structure, robust yoke design, and handle.

14 Claims, 10 Drawing Sheets

SPORTS RACKET

BACKGROUND OF THE INVENTION

This is a Sports Racket with innovative uniform elongated spring bed, uniform main stings and cross strings segments, uniform elongated sweet spot, uniform head structure, innovative robust yoke design, and handle.

Sport racquets, such as tennis, racquetball, squash and badminton racquets, are well known and typically include a frame having a head portion coupled to a handle portion. The head portion supports a string bed having a plurality of main string segments interwoven with a plurality of cross string segments. Many racquets also include a throat portion positioned between and connecting the handle portion to the head portion. The typical string bed of a sports racquet includes a central region, that provides the most responsiveness, the greatest power and the best "feel" to the player, upon impact with a ball, and a peripheral region. The central region, (the middle third of the racket) commonly referred to as the "sweet spot," is typically defined as the area of the string bed that produces higher power and control values. A higher power and control value generally directly corresponds to greater power and greater responsiveness.

The peripheral region is the region between the sweet spot and the hoop of the head portion of the racquet. The peripheral region provides increasingly reduced levels of responsiveness, power and feel to the player, the further away the location of impact occurs from the sweet spot. As a result, a typical racquet provides a wide variety of responsiveness and power depending upon the location of the impact. In many racquets, a miss-hit, occurring just a small distance away from the sweet spot, can produce an undesired response from the racquet. The significant variability in a string bed's power and responsiveness between the sweet spot and locations about the peripheral region can result in inconsistent play, if the player's racket does not consistently impact the ball at the sweet spot. The variability of the string bed response can also reduce the margin of error afforded to the player upon impact with a ball, which can contribute to unforced errors.

Some existing racquets incorporate a larger sized hoop portion supporting a larger sized string bed (i.e., a larger head size) in an effort to increase the size of the string bed and the sweet spot. However, as the head size of a racquet increases so does the polar moment of inertia of the racquet. A racquet with a higher polar moment of inertia can be more difficult to maneuver, particularly at the net or upon return of serve, than a racquet with a lower moment of inertia. Additionally, some users find large head racquets to be more difficult to swing than racquets with normal sized heads.

Other existing racquets extend the length of the central most main string segments in order to increase the size of the racquet's sweet spot. However, the central main string segments of a typical string bed are generally already of sufficient length to provide the desired response at the central most portions of the string. Further increasing the length of the already elongated central main string segments can produce too much variability in the string bed performance and potentially lead to a string bed with undesirable variability in response and performance.

Thus, there is a continuing need for a racquet having a string bed with an enlarged sweet spot, which does not negatively affect the overall performance of the racquet. It would be advantageous to produce a racquet with a string bed that provides a high level of response and power over a larger area, without producing excessive or undesirable variability in response or performance across the string bed. A racquet is needed, that can increase performance at the peripheral regions of the string bed and generally enlarge the sweet spot of the racquet. It would be advantageous to provide a racquet with an enlarged sweet spot without increasing the polar moment of inertia of the racquet head and without negatively affecting the maneuverability of the racquet. There is also a need for a racquet having a string bed with an enlarged sweet spot that is not a radical departure in look and design from traditional sport racquet designs.

There also exists a continuing need for innovative approaches to efficiently and reliably secure elongated racquet string(s) to a racquet. In particular, it would be advantageous to provide a racquet that allows elongated main string segments to be coupled or engaged to the yoke or handle of the racquet without producing unnecessary stress risers in the racquet frame. It would be desirable to produce a lightweight durable article for facilitating the passage of racquet strings through the racquet frame, and a method of making such an article, that can be incorporated into a composite racquet in a reliable and cost efficient manner. It would be advantageous if such a method were applicable to other composite sporting goods such as, for example, ball bats and golf shafts.

SUMMARY OF THE INVENTION

The present invention provides a sports racquet including a frame, a yoke and a string bed, a racquet with uniform elongated spring bed, uniform main stings and cross strings segments, uniform elongated sweet spot, uniform head structure, innovative/robust yoke design, and handle. The frame includes a head portion, a handle portion, and a yoke portion positioned between the head and handle portions. The head portion includes an upper region, and first and second side regions. The yoke is coupled to, and extending between, the first and second side regions. The head portion and the yoke define a string bed area. The string bed is formed of a plurality of cross string segments and a plurality of main string segments. The main string segments include at least one central main string segment and at least two peripheral main string segments. Each central main string segment has first and second ends wherein the first end engages the upper region of the head portion and the second end engages the yoke without engaging the handle portion. Each of the peripheral main string segments extends, across the string bed area, and through the yoke portion. Each peripheral main string segment is coupled at a distal end to the upper region of the head portion and at a proximal end to at least one of the yoke portion.

According to a principal aspect of the invention, a sports racquet configured to support a string bed formed by a plurality of transversely extending cross string segments and a plurality of longitudinally extending central main string segments and a plurality of longitudinally extending peripheral main string segments, wherein each of the central and peripheral main string segments have a distal end and a proximal end includes a frame, a yoke and at least two peripheral main strings. The frame includes a head portion, a handle portion, and a yoke portion positioned between the head and handle portions. The head portion includes an upper region, and first and second side regions. The yoke is coupled to and extends between, the first and second side regions. 'The head portion and the yoke define a string bed area. The yoke include a central section and first and second side sections. The central section is configured for engaging the proximal end of at least one central main string segment and the first and second side sections is configured to allow at least one peripheral main string segment to extend through the yoke.

According to another principal aspect of the invention, a sports racquet includes a frame and a string bed. The frame includes a head portion, a handle portion, and a yoke portion positioned between the head and handle portions. The string bed is coupled to the frame and is formed of a plurality of cross and main string segments. The main string segments include at least one central main string segment and at least two peripheral main string segments, wherein the string bed area, the length of each of the peripheral main string segments is shorter than the length of each of the central main string segments.

According to another principal aspect of the invention, a sports racquet includes a frame, a yoke, at least two central main string segments, and at least two peripheral main string segments. The frame extends along a longitudinal axis and includes a head portion, a handle portion, and a yoke portion positioned between the head and handle portions. The head portion includes first and second side regions. The yoke is coupled to, and extends between, the first and second side regions. The central main string segments include at least one central-most main string segment having a first length. The central-most main string segment is positioned at, or adjacent to, the longitudinal axis, the second length being at least (99.67) percent of the first length, the third length being at least (99.35) percent of the first length, the fourth length being at least (97.06) percent of the first length, the fifth length being at least (94.72) percent of the first length, the sixth length being at least (91.60) percent of the first length, the seventh length being at least (87.63) percent of the first length, the eighth length being at legit (82.66) percent of the first length, the ninth length being at least (76.49) percent of the first length.

The peripheral main string segments include at least one outermost peripheral main string segment. The outermost peripheral main string segment has a second length. The outermost peripheral main string segment is spaced apart from the latitudinal axis and is positioned perpendicular to one of the first and second side regions of the head portion. The second length being at least (100) percent of the first length, the third length being at least (100) percent of the first length, the fourth length being at least (99.62) percent of the first length, the fifth length being at least (99.24) percent of the first length, the sixth length being at least (96.52) percent of the first length, the seventh length being at least (93.76) percent of the first length, the eighth length being at least (90.07) percent of the first length, the ninth length being at least (85.38) percent of the first length, the tenth length being at least (79.51) percent of the first length, the eleventh length being at least (72.22) percent of the first length.

According to another principal aspect of the invention, a method of producing a sporting goods article includes obtaining a structural element formed of a thermoplastic material, the thermoplastic material having a melting point greater than 325 degrees Fahrenheit.

This invention will become more fully understood from the following detailed description, taken in conjunction with the accompanying drawings described herein below, and wherein like reference numerals refer to like parts.

BRIEF DESCRIPTION OF THE DRAWINGS

The present invention relates generally to a sports racquet. In particular, the present invention relates to a racquet including innovative uniform elongated string bed, with uniform elongated peripheral and main string segments providing a uniform elongated and enlarged sweet spot, uniform head structure, innovative robust yoke design, and handle.

DETAILED DESCRIPTION OF THE PREFERRED EMBODIMENTS

Figure 1:
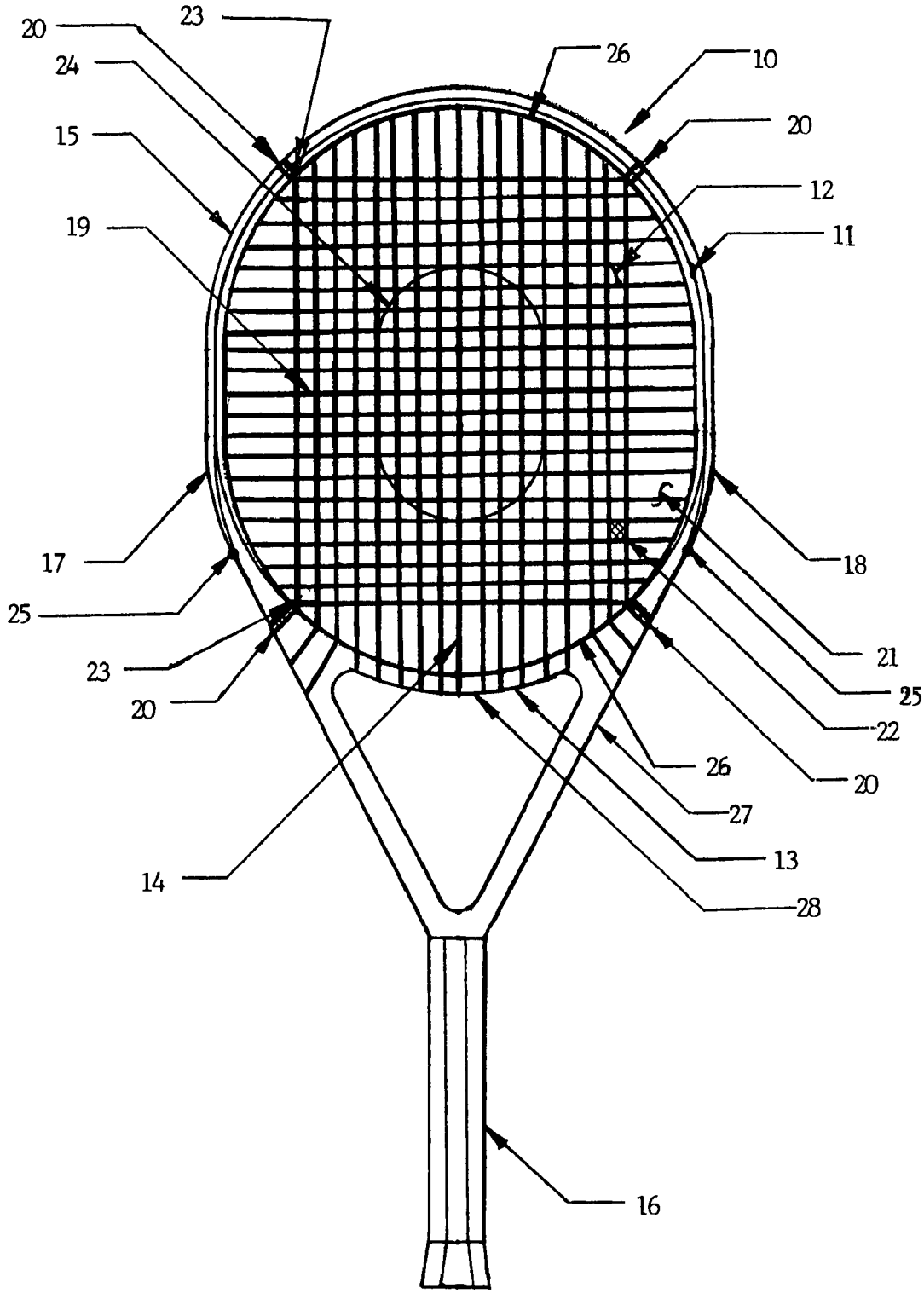
FIG. 1 is a front view of a racquet in accordance with a preferred embodiment of the present invention.
Figure 2:
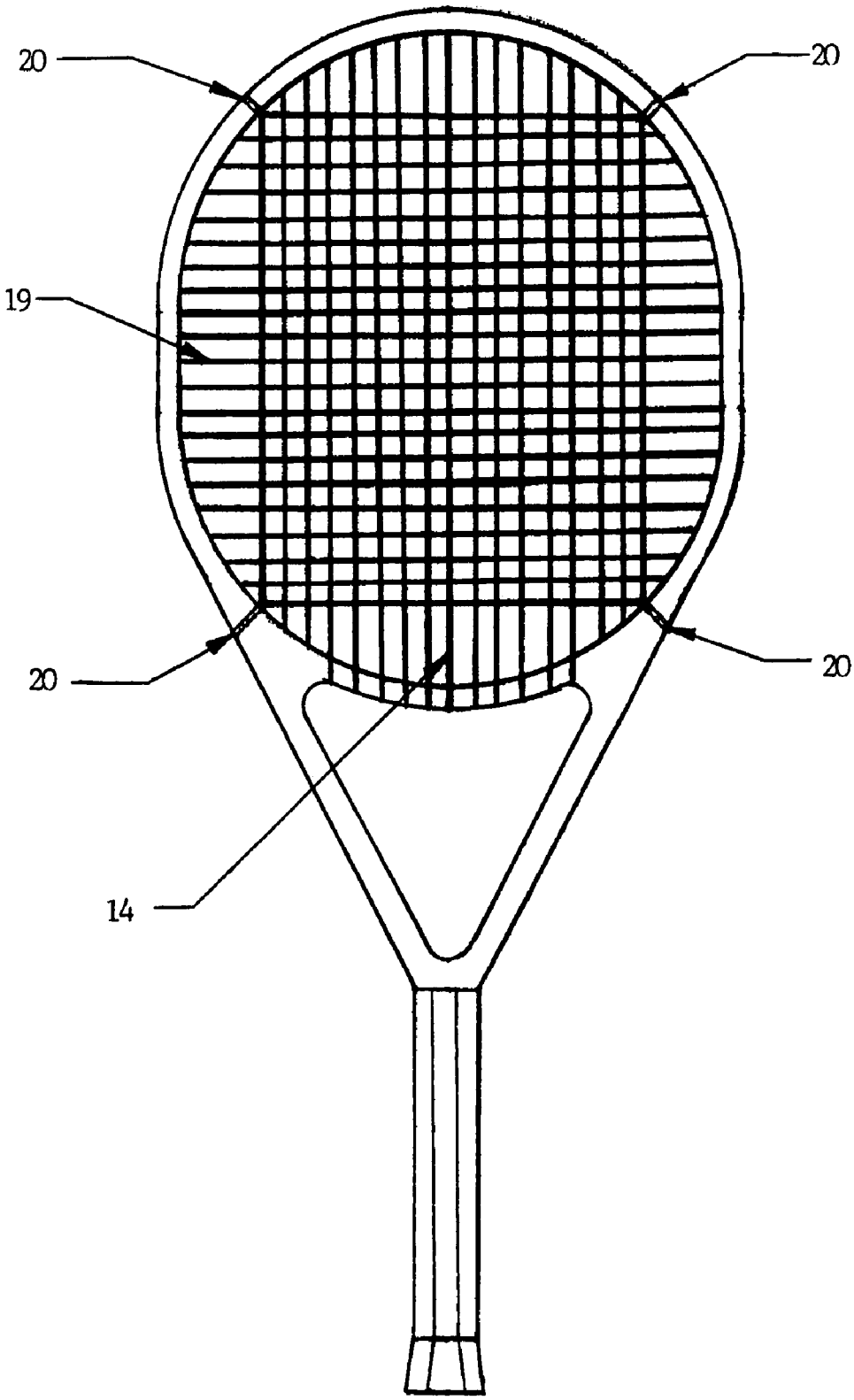
FIG. 2 is a front perspective view of a yoke and a portion of the racquet of FIG. 1.
Figure 3:
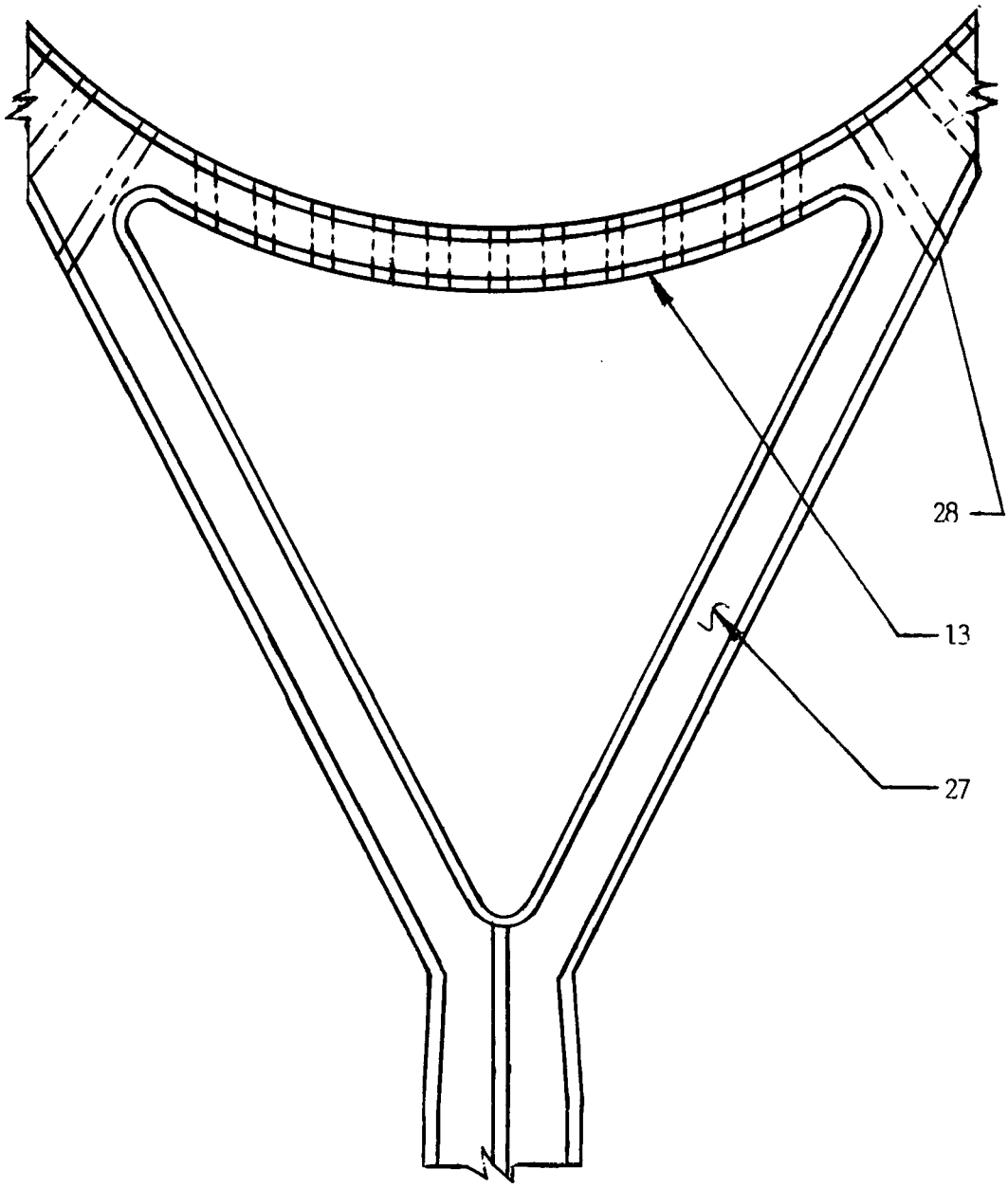
FIG. 3 is a section view of the yoke portion of the racquet with a preferred embodiment of the present invention.
Figure 4:
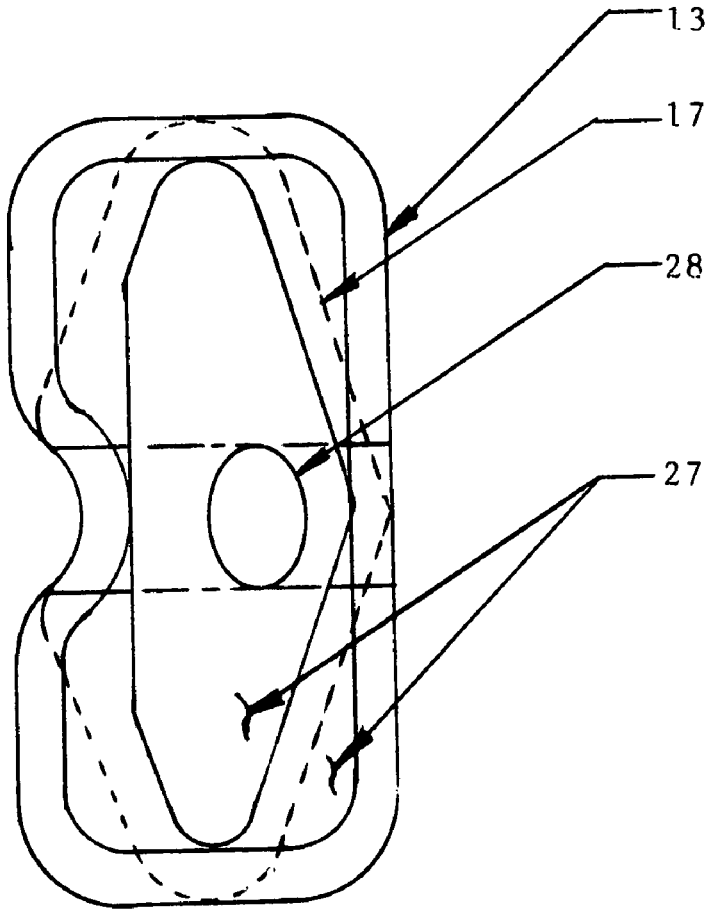
FIG. 4 is an edge perspective sectional view of a yoke portion of a racquet in accordance with a preferred embodiment of the present invention.
Figure 5:
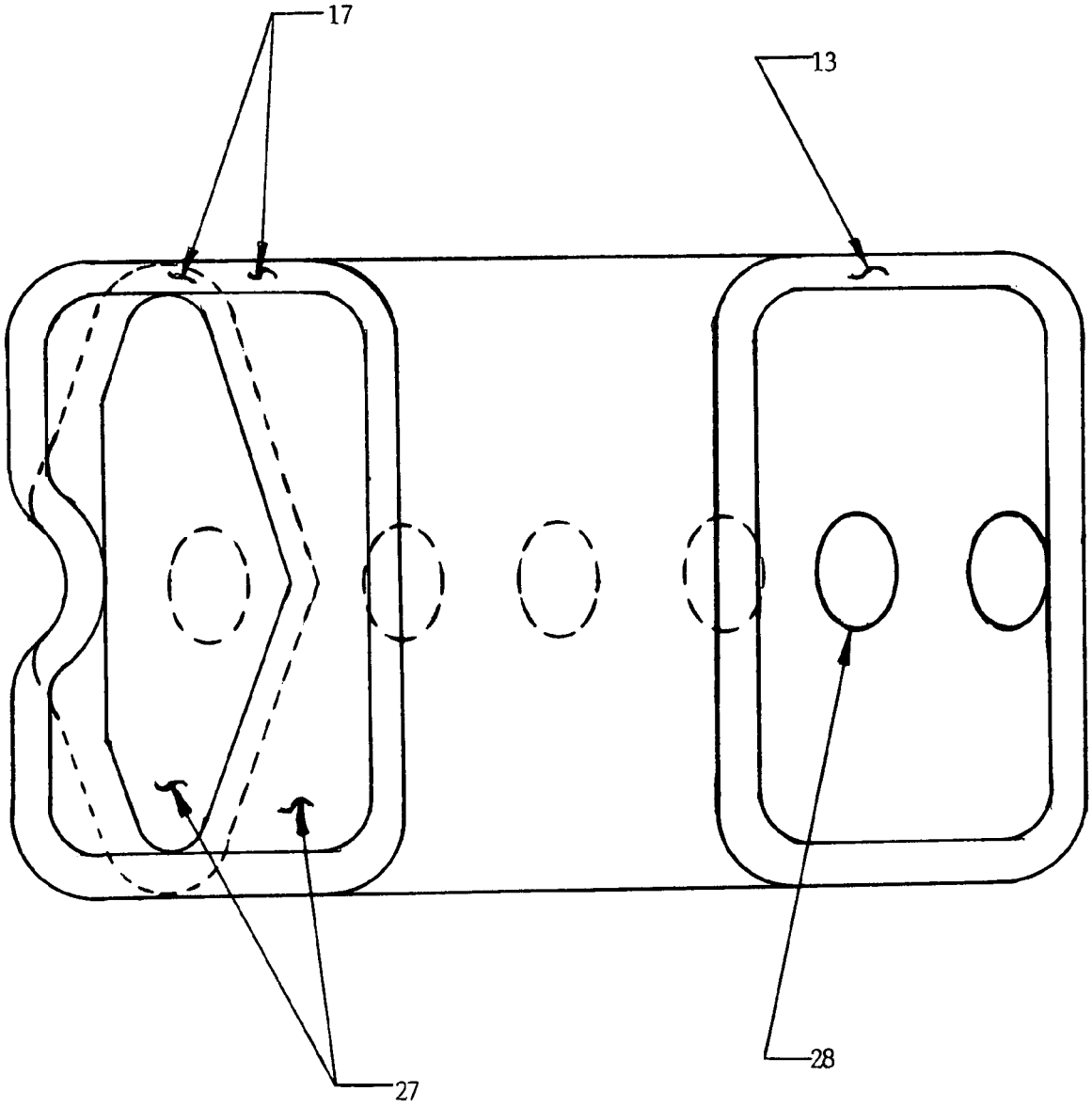
FIG. 5 is a sectional edge view of the yoke portion of the racquet as viewed from a section of the end.
Figure 6:
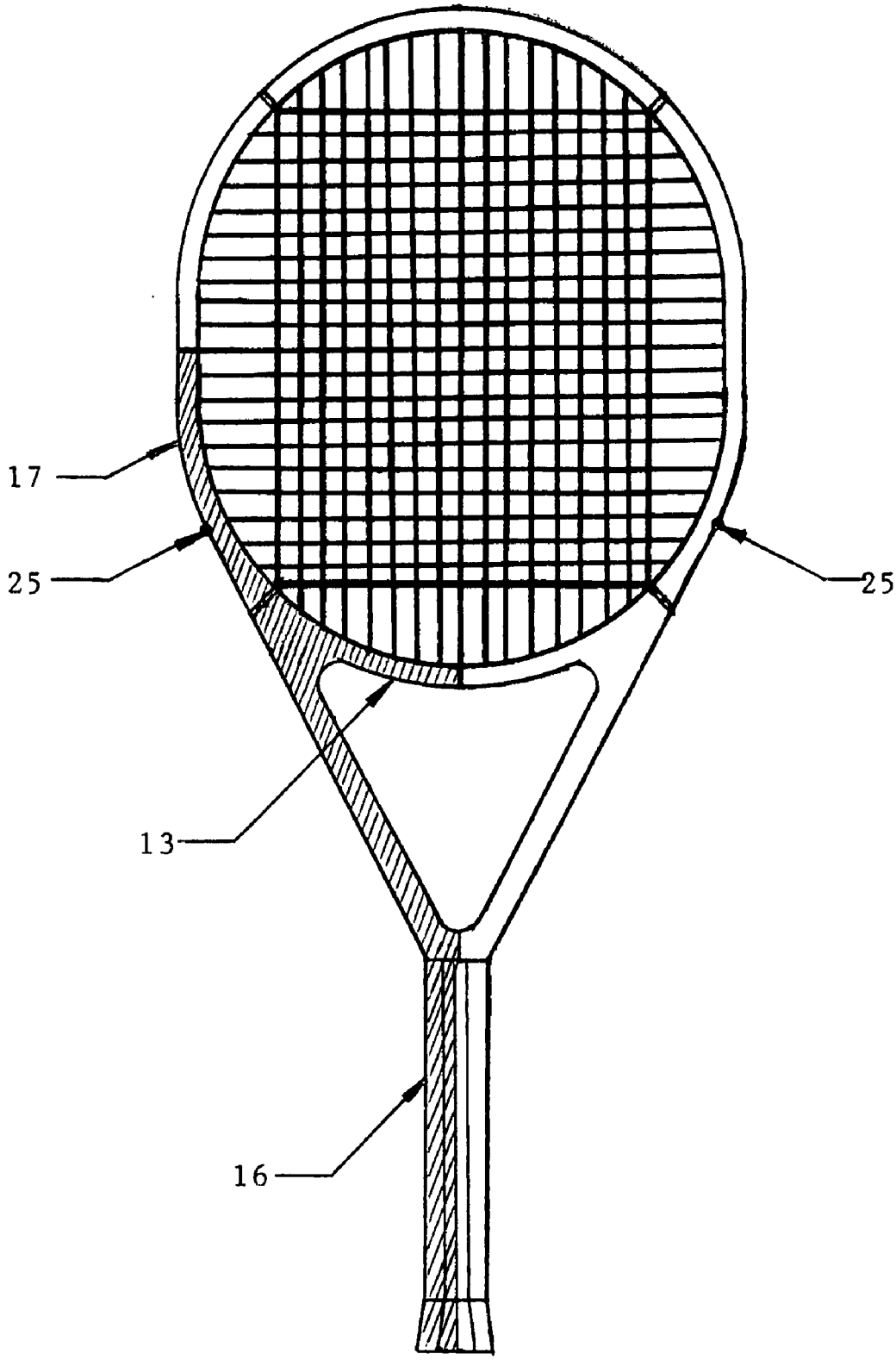
FIG. 6 is a front partial sectional view of a racquet in accordance with another preferred embodiment of the present invention.
Figure 7:
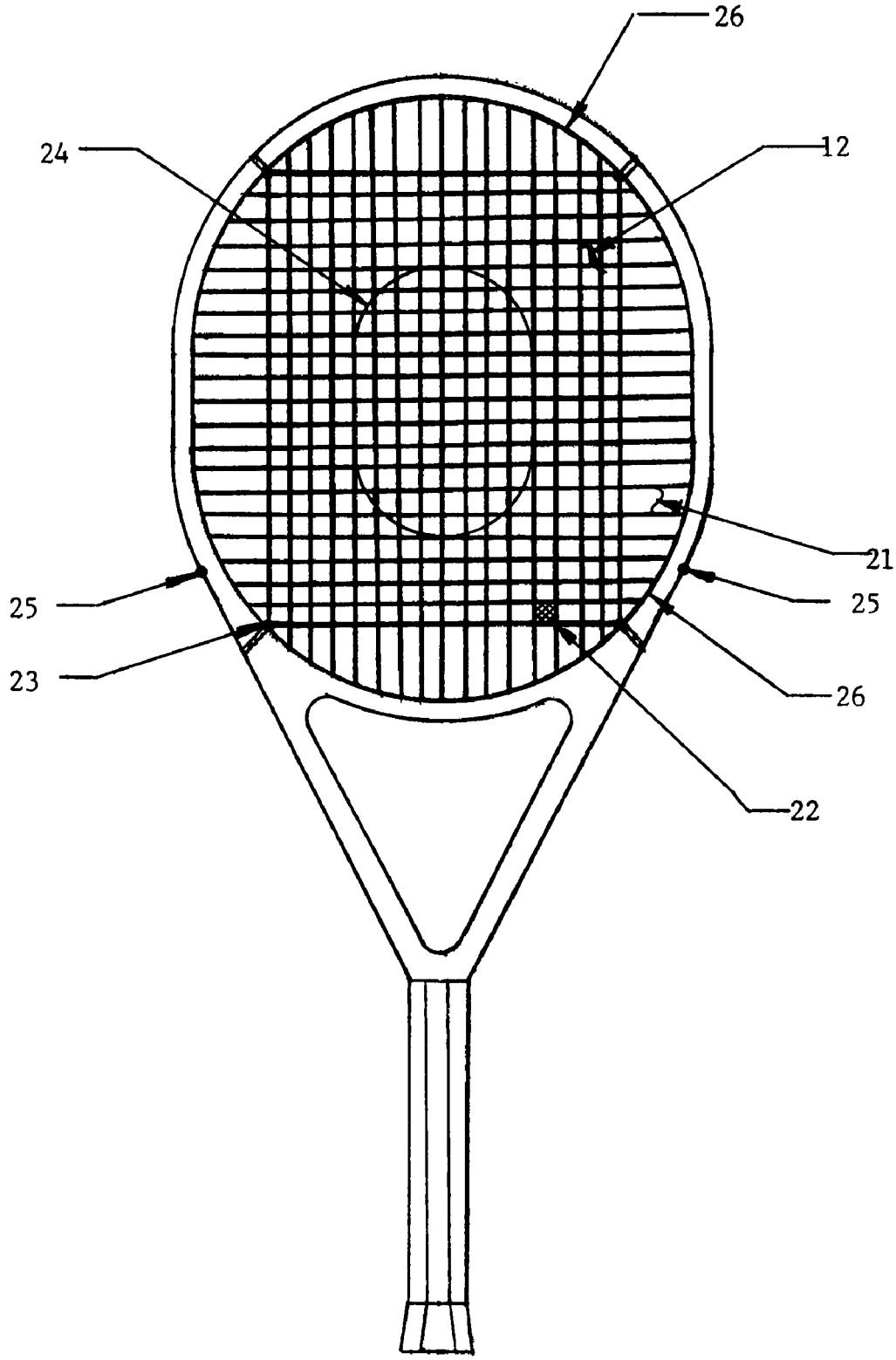
FIG. 7 is a front view of a racquet in accordance with additional preferred embodiment of the present invention.
Figure 8:
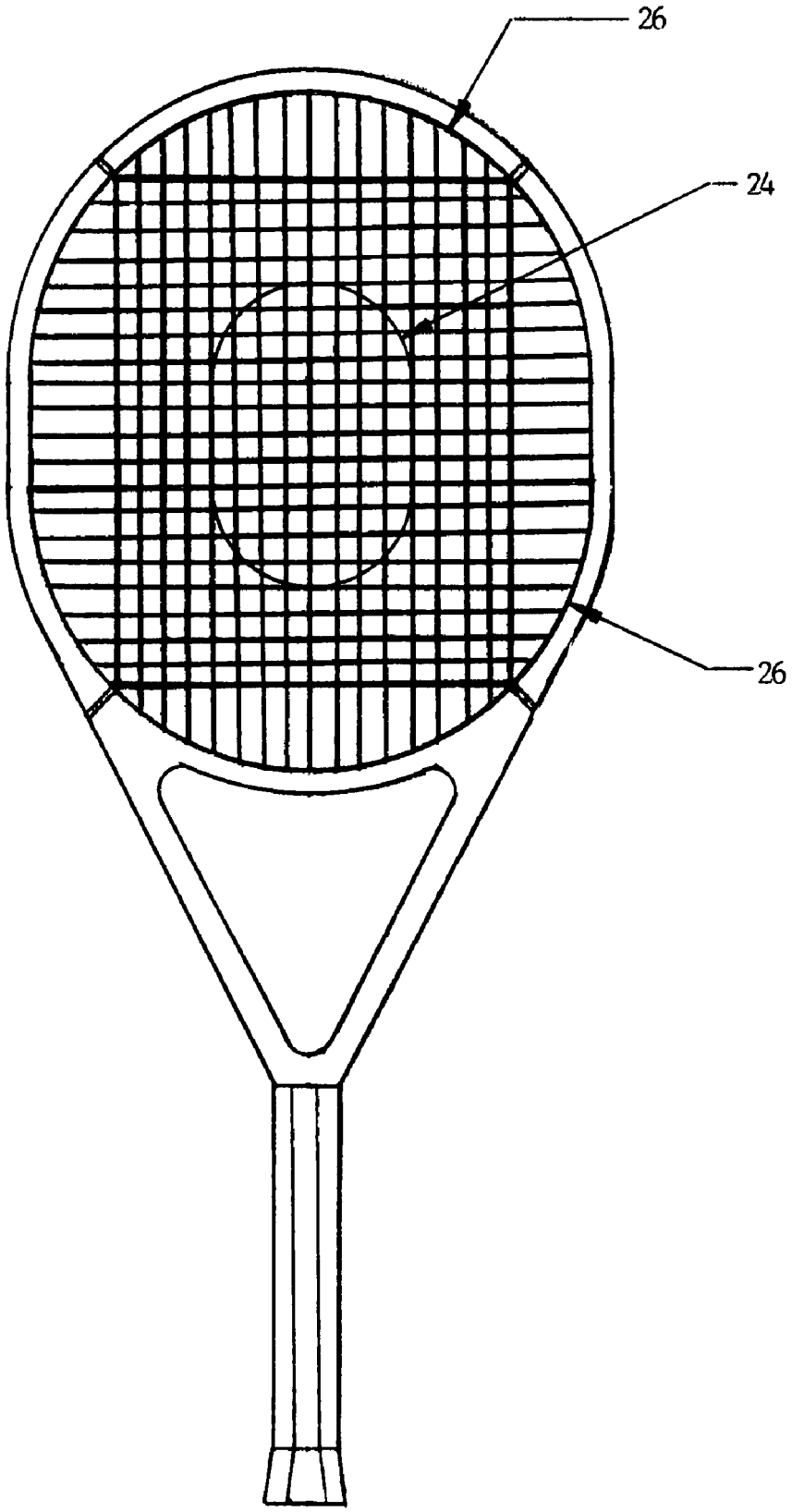
FIG. 8 is a front view of a racquet in accordance with additional preferred embodiment of the present invention.
Figure 9:
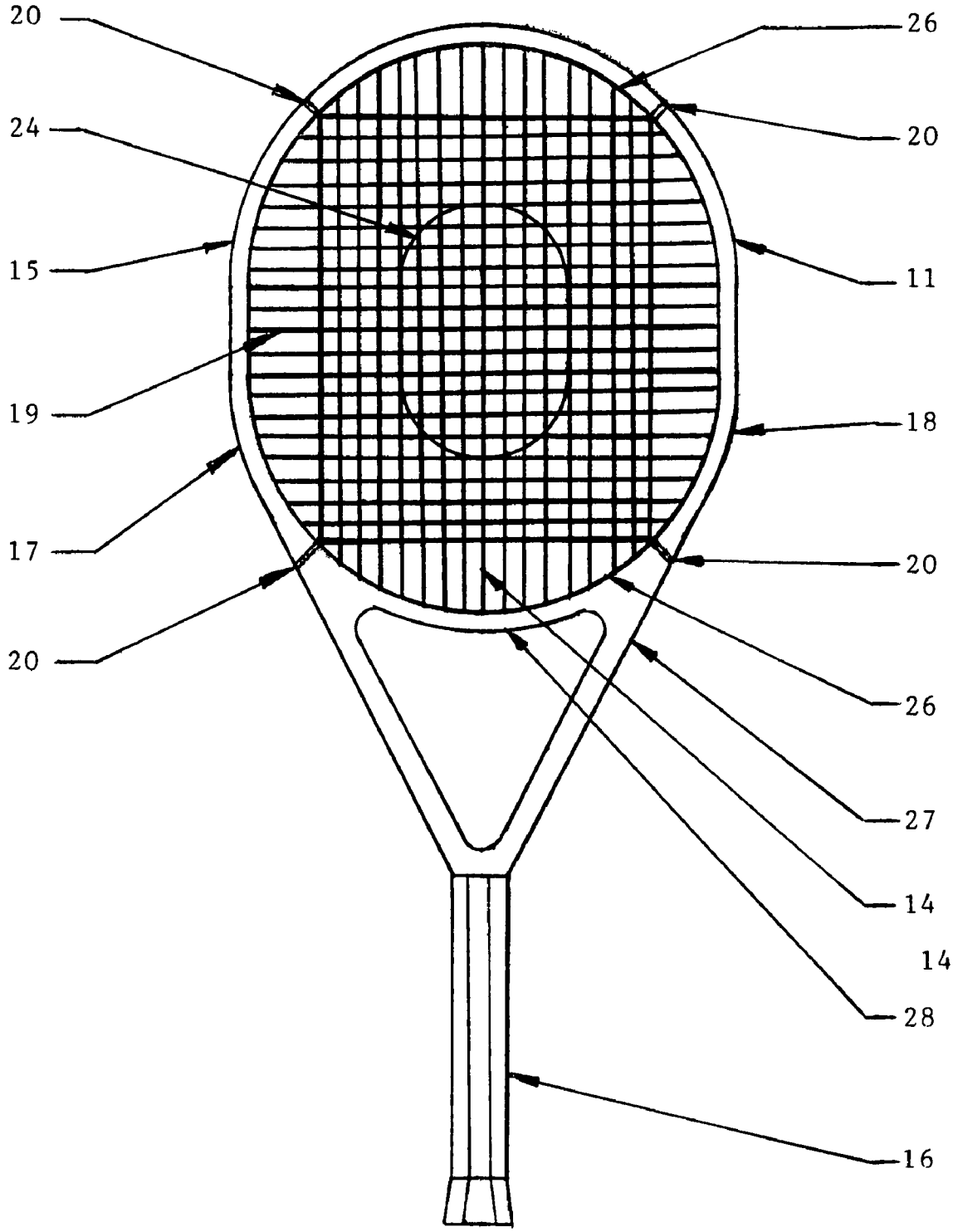
FIG. 9 is a front view of a racquet in accordance with additional preferred embodiment of the present invention.
Figure 10:
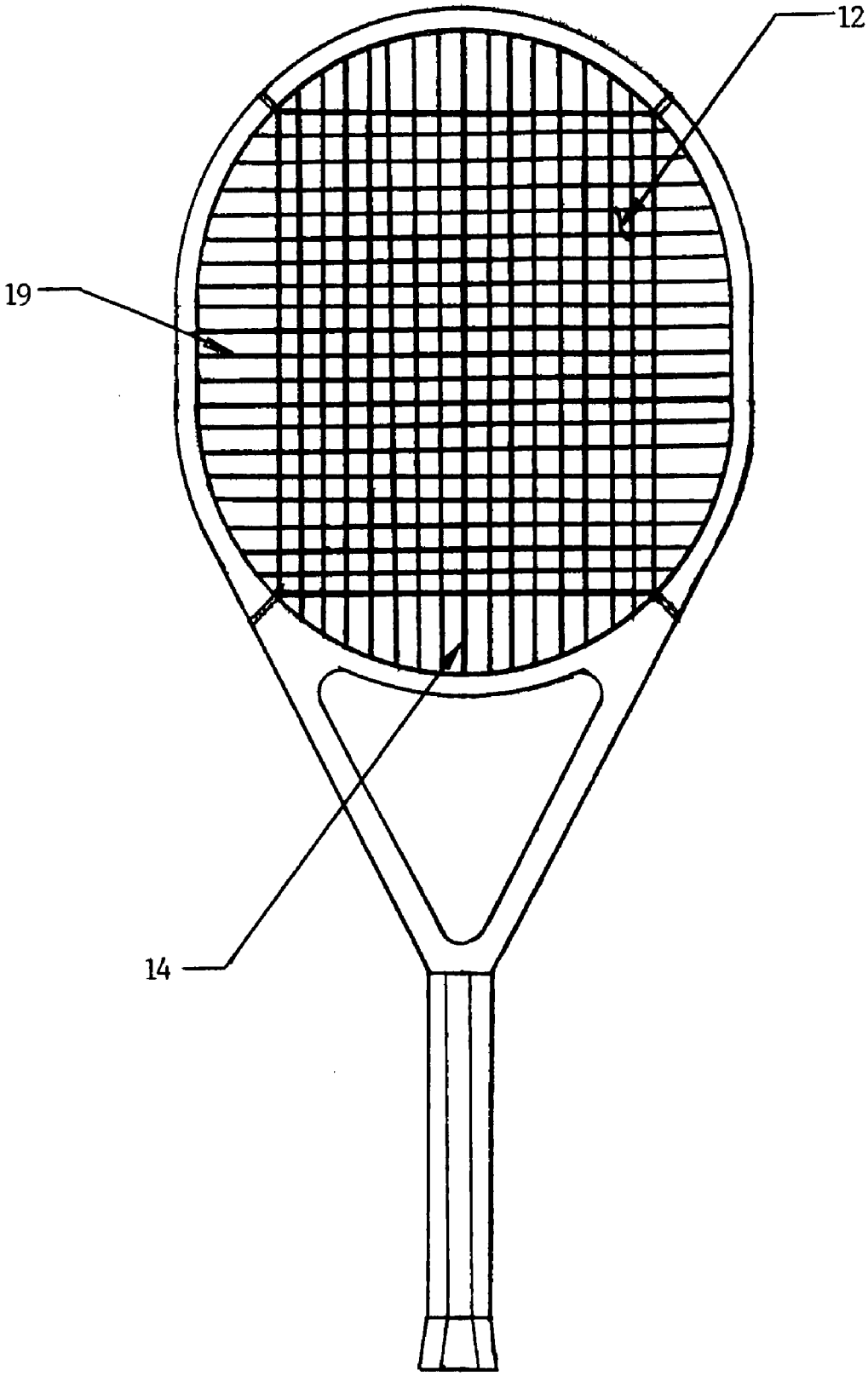
FIG. 10 is a front view of a racquet in accordance with additional preferred embodiment of the present invention.

Referring to FIGS. 1 through 10, a sports racquet is indicated generally at 11. The racquet 10 of FIG. 1 is configured as a tennis racquet; however, the invention can also be formed as other types of sports racquets, such as, for example, a squash racquet, a racquetball racquet, or a badminton racquet. The racquet 10 includes a frame 11, a string bed 12 and a yoke 13. The frame 11 is a tubular structure having a longitudinal axis 14 and including a head portion 15, a handle portion 16. The frame 11 is formed of a lightweight, durable material, preferably a carbon-fiber composite material. Alternatively, the frame 11 can be formed of other materials including metallic alloys, other composite materials, or combinations thereof. The head portion 15 forms an upper region: upper uniform radius 26, spring bed anchor point 23, two pair of string holes 20, the sweet spot 24, the 16×16 (½ inch) square pattern 22, the support pattern 21, first and second side regions 17 and 18, and together with the yoke 13 defines a string bed area 12 and an innovative, wide head to handle attachment point 25.

In a preferred embodiment, the first and second side regions 17 and 18 downwardly extend from the head portion 15. The converged first and second side regions 17 and 18 then further downwardly extend to form the lower uniform radius 26, the open chambers 27, channels of holes and airways 28, and the handle portion 16. The handle portion 16 includes a grip (not shown). In alternative preferred embodiments, the handle portion 16 can be a tubular structure that is formed separately from either the yoke portion or the head portion of the frame and is attached to the first and second side region through use of conventional fasteners, adhesives or combinations thereof.

In another preferred embodiment, the head portion 15 is directly connected to both of the side regions and the yoke 13 using conventional fastener, adhesives, mechanical bonding, thermal bonding, or other combinations thereof. Alternatively, the head portion 15 can be separated from one or both of the side regions and the yoke by a vibration and shock absorbing material, such as an elastomer. In yet another alternative preferred embodiment, the head portion I5 is integrally formed with one or both of the side regions 17 and 18 and the yoke 13.

The string bed 12 is formed by a plurality of main string segments interwoven with a plurality of cross string segments 19. The main and cross string segments can be formed from one continuous piece of racquet string, or from two or more pieces of racquet string. The cross string segments 19 and most of the main string segments are engaged with the head portion 15 of the frame, preferably by extending through string holes (not shown) within the head portion 15. Alternatively, the string segments can be wrapped around or otherwise secured to the head portion through fasteners or other conventional means.

The cross string segments 19 generally transversely extend from the first side region 17 across the string bed area 12 to the second side region 18. The main string segments extend from the upper region 11 and the upper ends of the first and second side regions 17 and 18 of the head portion 15 generally downward across the string bed area 12 toward the yoke 13. The main string segments include at least one central main string segment(s) 14 and a plurality of peripheral main string segments 19. The central main string segments 14 are positioned at or near the centrally positioned longitudinal axis 14 of the racquet 10. The number of central main string segments 14 in a racquet 10 of the present invention can vary from one to a value equivalent to two less than the total number of main string segments. In a particularly preferred embodiment (FIG. 1), the racquet 10 includes seventeen central main string segments 14 and twenty-one peripheral cross string segments 19.

The yoke 13 is an elongate tubular structural member, which extends from the first side region 17 to the second side region 18 of the head portion 15. In one preferred embodiment, the yoke 13 is integrally formed with the frame 11. In alternative preferred embodiments, the yoke 13 can be connected through use of adhesives, fasteners, bonding and combinations thereof. In another embodiment, the yoke 13 can be separated from the frame 11 by vibration absorbing material, such as, for example, an elastomer. The yoke 13 is formed of a lightweight, durable material, preferably a carbon-fiber composite material. Alternatively, the yoke 13 can be formed of other materials, such as, for example, metallic alloys, other composite materials, and combinations thereof. The yoke 13 provides structural support to the frame 11, as well as a means for defining the lower portion of the string bed area 12 and a support for engaging, routing or directing the main string segments.

In embodiments, the sports racket includes first and second tubular members that include at least two pairs of strings holes 20, and wherein the two pairs of string holes are generally symmetrically spaced from each other about a plane defined by the string bed. The string pattern is innovative and unique and is anchored at four strategic points to produce a uniform response when the ball lands on the racket stings. The anchor location is at equal radial distances from the elongated sweet spot. The response is an equal and opposite response of the ball, from the racket.

In embodiments, the sports racket may be formed with open chambers, channels of holes, and airways to allow for and make the racket one with the atmosphere, thereby eliminating the vacuum effect and allowing air-flow through the racket during the acceleration and deceleration of the racket; which reduces drag that would otherwise exhibit itself. The airflow through the open chambers, channels of holes and airways a makes a high pitch sound, that is associated with speed and acceleration rather than a low pitch sound associated with resistance and deceleration, wherein the feel produced by the added speed and acceleration produces a psychological and inspirational advantage.

In embodiments, the sports racket comprises a robust, rectangular, dual expanded I-Beam yoke portion and side regions having a reinforced midsection for a higher polar moment of inertia at the midsection, resistance to vibration and flexing of the racket upon impact of the ball.

In embodiments, the yoke, side regions and handle are integrally formed with the head portion wherein the width of the head to handle attachment point, of the handle is 10.63 inches in width, the length of the head to handle attachment point of other rackets is approximately 7.50 inches in width, wherein the 3.13 inches in extra width, of the innovative design, reduces moment of inertia in direct proportion to the difference in extra width, therefore reducing the twisting force that causes the racket handle to twist, in the hand, when the ball impact the racket during the execution of the tennis stroke.

In embodiments, the string pattern is anchored at four strategic points to produce a pivot point and a uniform response when the ball lands on the racket stings, wherein the anchor location is at equal radial distances from the elongated sweet spot and at a 45 degree angle from the central main strings and the peripheral main strings, wherein the response is an equal and opposite response, of the ball, from the racket when a ball strikes the racket.

In embodiments, a combination of two uniform radiuses of the head and the yoke, with the uniform 16×16 one half inch (½ inch) squares and the uniform two-inch elongation along the longitudinal axis, enhance the uniform response of the racket, when the ball rebounds off the racket strings, wherein the uniformity in tension, prevents an uneven response and insures an equal and opposite response, when the racket hits the ball.

In embodiments, when the ball hits the racket, the ball is addressed by four strings for every square that touches the ball, wherein the string tension may be adjusted to a lower tension to allow more of the squares to touch the ball, wherein when stroking the ball it may be depressed to cover up to (one square inch) four squares, wherein the ball is recessed through the strings by approximately 0.03 of an inch each time the racket touches the ball.

In embodiments, the string pattern consists of three hundred and twenty squares, the spring bed is elongated by two inches, which increases the sweet spot by two inches, wherein the squares are anchored at four anchor holes on the racket head, which act as four flex points for the string bed to react to the ball on impact. In embodiments, the string bed has 356 degrees of freedom to separate it from the support pattern and the string bed has two inches of space on all four sides, to increase leverage, for added power to the racket. In embodiments, the string holes of the first and second tubular members of the yoke portion are aligned to be substantially coplanar with the string bed, and the plurality of string holes includes at least two pairs of strings holes in each of the first and second tubular members and the two pairs of string holes are generally symmetrically spaced from each other about a longitudinally extending plane that is generally centrally positioned along the frame, produce a uniform response when the ball land on the racket strings. The response is an equal and opposite response, of the ball, from the racket.

In embodiments, the sports racket includes an extra long (8.8 inches) gripping section of the handle, which gives it flexibility in handling and provide for a variety of grips for both one-handed and two handed grips, also, for switching hands and grips.

In embodiments, at least one central main string segments include at least one central-most main string segment having a first length, the central-most main string segment being positioned at, or adjacent to, the longitudinal axis of the sports racket; and at least one central main string segment includes at least one outermost central main string segment, the outermost central main string segment having a second length, the outermost central main string segment being spaced apart along the longitudinal axis and being positioned adjacent to one of the first and second side regions of the head portion, the second length being at least 99.67 percent of the first length, the third length being at least 99.35 percent of the first length, the fourth length being at least 97.06 percent of the first length, the fifth length being at least 94.72 percent of the first length, the sixth length being at least 91.60 percent of the first length, the seventh being, at least 87.63 percent of the first length, the eighth length being at least 82.66 percent of the first length, the ninth length being at least 76.49 percent of the first length.

In embodiments, the central-most main string segment is positioned at, or adjacent to, the longitudinal axis of the sports racket and at least two peripheral main string segments including at least one outermost peripheral main string segment, the outermost peripheral main string segment having a second length, the outermost peripheral main string segment being spaced apart along the latitudinal axis and being positioned perpendicular to one of the first and second side regions of the head portion, the second length being at least 100 percent of the first length, the third length being at least 100 percent of the first length, the fourth length being at least 99.62 percent of the first length, the fifth length being at least 99.24 percent of the first length, the sixth length being at least 96.52 percent of the first length, the seventh length being at least 93.76 percent of the first length, the eighth length being at least 90.07 percent of the first length, the ninth length being at least 85.38 of the first length, the tenth length being at least 79.51 percent of the first length, the eleventh length being at least 72.22 percent of the first length.

The above specifications are detailed descriptions of specific embodiments of the invention and was set forth for the purpose of illustration. It will be understood that many of the details herein given can be varied considerably, by those skilled in the arts, without departing from the spirit and scope of the invention.

The invention claimed is:

1. A sports racket, comprising:

a head;

the head being formed by an upper circular curved section having a uniform radius comprising a concave side, a first straight side section connected to one end of the upper curved section and a second straight side section that is connected to another end of the upper curved section; and a yoke;

the yoke comprising a circular curved portion having a same uniform radius as the upper circular curved section and comprising a concave side, the yoke being connected to an end of the first straight side section and an end of the second straight side section opposite to the upper curved section, wherein the head and the yoke define a string bed area such that the concave side of the upper circular curved section and the concave side of the circular curved portion of the yoke face the string bed area;

wherein a string bed is formed in the string bed area by a plurality of longitudinally oriented strings and a plurality of transversely oriented strings interwoven with the longitudinally oriented strings forming a uniform grid pattern of a plurality of squares, wherein each square has a same size.

2. The sports racket according to claim 1, wherein the yoke has a portion having a triangular cross-section and the head has a portion having a rectangular cross-section.

3. The sports racket according to claim 1, wherein the grid is a 16×16 square grid pattern and each side of each square of the grid is one-half inch long.

4. The sports racket according to claim 3, wherein the first straight side section and the second straight side section are each two inches long.

5. The sports racket according to claim 1, wherein the string bed comprises four anchor points that are each located at an equal distance from a center of the string bed area, wherein the anchor points are points on the head and the yoke where one longitudinally oriented string and one transversely oriented string are attached.

6. The sports racket according to claim 3, wherein the string bed comprises a two inch long section of string between an inner circumference of the string bed area and the uniform grid pattern of the string bed.

7. The sports racket according to claim 1, wherein at least five transversely oriented strings have a same length.

8. The sports racket according to claim 1, further comprising:

a handle that is 8.8 inches in length and connected to the yoke.

9. The sports racket according to claim 1, wherein a center string of the transversely oriented strings and two adjacent transversely oriented strings are a same length.

10. The sports racket according to claim 1, wherein the yoke and/or the head comprises a plurality of through holes that allow air to flow through the through holes during movement of the racket.

11. The sports racket according to claim 1, wherein a width of a head to handle attachment point of the handle is 10.63 inches in width.

12. The sports racket according to claim 1, wherein the plurality of longitudinally oriented strings comprises:

a centermost string that is positioned substantially at, or adjacent to, the longitudinal axis and has a first length;

a second longitudinally oriented string that is adjacent to the centermost string and has a length is at least 99.67 percent of the first length;

a third longitudinally oriented string that is adjacent to the second longitudinally oriented string and has a length is at least 99.35 percent of the first length;

a fourth longitudinally oriented string that is adjacent to the third longitudinally oriented string and has a length is at least 97.06 percent of the first length;

a fifth longitudinally oriented string that is adjacent to the fourth longitudinally oriented string and has a length is at least 94.72 percent of the first length;

a sixth longitudinally oriented string that is adjacent to the fifth longitudinally oriented string and has a length is at least 91.60 percent of the first length;

a seventh longitudinally oriented string that is adjacent to the sixth longitudinally oriented string and has a length is at least 87.63 percent of the first length;

an eighth longitudinally oriented string that is adjacent to the seventh longitudinally oriented string and has a length is at least 82.66 percent of the first length;

a ninth longitudinally oriented string that is adjacent to the eighth longitudinally oriented string and has a length is at least 76.49 percent of the first length.

13. The sports racket according to claim 1, wherein the plurality of transversely oriented strings comprises:

a centermost string that is positioned substantially at, or adjacent to, a transverse axis and has a first length;

a second transversely oriented string that is adjacent to the centermost string and has a length is at least 100 percent of the first length;

a third transversely oriented string that is adjacent to the second longitudinally oriented string and has a length is at least 100 percent of the first length;

a fourth transversely oriented string that is adjacent to the third longitudinally oriented string and has a length is at least 99.62 percent of the first length;

a fifth transversely oriented string that is adjacent to the fourth longitudinally oriented string and has a length is at least 99.24 percent of the first length;

a sixth transversely oriented string that is adjacent to the fifth longitudinally oriented string and has a length is at least 96.52 percent of the first length;

a seventh transversely oriented string that is adjacent to the sixth longitudinally oriented string and has a length is at least 93.76 percent of the first length;

an eighth transversely oriented string that is adjacent to the seventh longitudinally oriented string and has a length is at least 90.07 percent of the first length;

a ninth transversely oriented string that is adjacent to the eighth longitudinally oriented string and has a length is at least 85.38 percent of the first length;

a tenth transversely oriented string that is adjacent to the ninth longitudinally oriented string and has a length is at least 79.51 percent of the first length;

a eleventh transversely oriented string that is adjacent to the tenth longitudinally oriented string and has a length is at least 72.22 percent of the first length.

14. The sports racket according to claim 1, wherein at least one of the upper curved section, the first straight side section, the second straight side section and the yoke are connected to one another by a vibration absorbing elastomer material.

* * * * *